United States Patent [19]

Ayres et al.

[11] 4,227,060

[45] Oct. 7, 1980

[54] LOCATING MEANS FOR AN ELECTRIC SWITCH

[75] Inventors: Frederick C. Ayres, Cheltenham; Philip V. Little, Stroud, both of England

[73] Assignee: Bonnella Switches Limited, Cheltenham, England

[21] Appl. No.: 43,249

[22] Filed: May 29, 1979

[30] Foreign Application Priority Data

May 30, 1978 [GB] United Kingdom ..... 23963/78
May 31, 1978 [GB] United Kingdom ..... 25154/78

[51] Int. Cl.[3] ..... H01H 13/18

[52] U.S. Cl. ..... 200/296; 200/61.89; 248/27.1

[58] Field of Search ..... 248/27.1, 27.3; 200/296, 295, 61.89, 293, 294

[56] References Cited

U.S. PATENT DOCUMENTS

| | | | |
|---|---|---|---|
| 1,284,890 | 11/1918 | Greenleaf | 248/27.1 |
| 2,424,757 | 7/1947 | Klumpp | 248/27.3 |
| 3,115,559 | 12/1963 | Cass et al. | 200/295 |
| 3,172,983 | 3/1965 | Zoda | 200/295 |
| 3,273,104 | 9/1966 | Krol | 200/295 |
| 3,319,909 | 5/1967 | Goslin | 248/27.3 |
| 3,985,196 | 10/1976 | Deschamps | 200/61.89 |
| 4,181,834 | 1/1980 | Kyonomine | 200/295 |

*Primary Examiner*—John W. Shepperd
*Attorney, Agent, or Firm*—Lee & Smith

[57] ABSTRACT

To locate an electric switch relative to a fixed part a bush having a plurality of mating members and a projection in an opening through the bush is positioned in the fixed part. The switch is positioned at one end of a switch carrier having an elongate portion which is also provided with mating members and a projection. The elongate portion is introduced axially into the opening and then rotated to cause the mating members to engage and axially locate the elongate portion in the opening. The projections take up relative positions in which they only permit rotation in the opposite direction to disengage the mating members when sufficient force is applied to deform one or both of the projections.

10 Claims, 7 Drawing Figures

LOCATING MEANS FOR AN ELECTRIC SWITCH

This invention relates to means for locating an electric switch with respect to a fixed position.

In certain applications, particularly in a motor vehicle, it is necessary to locate an electric switch with respect to a fixed position such as a part of the motor vehicle. A particular application is to locate a switch for the stop lamps of a motor vehicle at a fixed distance from the brake pedal of the vehicle so that an actuating member of the switch is in engagement with the brake pedal when the brakes are not applied but is not in engagement with the pedal when the latter is depressed to apply the brakes of the vehicle. During the assembly of the motor vehicle the electric switch and the pedal are mounted in the vehicle but due to assembly tolerances the distance between the mounting location for the switch and the brake pedal can vary considerably. Consequently the actuating member of the switch may not be in engagement with the pedal when the pedal is in its normal position where the brakes are not applied.

Furthermore, if the switch and the pedal are assembled in their correct positional relationship, a nut and a lock nut have to be used to secure the switch to its mounting to prevent the switch from becoming loose due to vibration.

It is an object of the present invention to provide a locating means for an electric switch in which this difficulty is overcome.

Accordingly, the invention resides in the combination of

- a body having
  - an opening therein,
  - a plurality of members extending around part of the side wall of the opening, said member being arranged side-by-side in the direction parallel to the depth of the opening, and
  - a projection projecting from the side wall into the opening and
- a switch carrier having
  - an elongate portion,
  - a plurality of members extending around part of the side wall of the elongate portion, said members being arranged side-by-side in the direction parallel to the length of the elongate portion and
  - a projection projecting outwardly from the side wall of the elongate position, the opening in the body and the elongate portion of the switch carrier being such that the elongate portion is insertable in the direction of its length into the opening and by causing limited relative rotation between the elongate portion of the carrier and the body in a first direction members on the body and members on the carrier mate together to axially locate the carrier in the body and the projections being such that said relative rotation in the first direction cause them to take up relative positions which prevent relative rotation between the body and the elongate portion in the opposite direction unless the applied force to bring about relative rotation in said opposite direction is sufficient to deform one or both of the projections.

The elongate portion of the switch carrier is insertable in the opening in the body so that the carrier can take up the required position relative to the body. On bringing about limited relative rotation in the first direction, the members on the carrier and body mate together to prevent the carrier from being displaced axially relative to the body. Under certain conditions however it may be necessary to withdraw the carrier from the body but to prevent this from occuring unnecessarily, due to say vibration, the projections on the body and the carrier prevent relative rotation between the carrier and the body from occuring unless sufficient force is applied to cause the projection on the body to deform to allow the members to disengage and permit the elongate portion of the carrier to be withdrawn from the opening. The projection on the body and optionally that on the carrier is made elastically deformable but it is arranged that normal vibration forces which may occur are insufficient to deform the projections sufficiently to allow the members to become disengaged.

The members on the body and on the carrier conveniently comprise ribs separated by grooves and the limited rotation in the first direction cause ribs on the body or the carrier to mate with grooves on the carrier or the body. Two sets of ribs separated by grooves may be provided on the body and on the elongate portion of the switch carrier. The or each set of ribs and grooves on the body and on the switch carrier are preferably inclined to the length of the opening and to the length of the elongate portion respectively such that the limited relative rotation in the first direction causes the switch carrier to be displaced slightly in the direction opposite to the direction of entry of the elongate portion into the opening.

The elongate portion of the carrier is conveniently of tubular form with an end portion thereof supporting or forming part of the electric switch, and a plunger which serves as an actuating member for the switch extends through the tubular elongate portion and projects from the opposite end thereof.

In order that the invention may be more readily understood it will now be described, by way of example only, with reference to the accompanying drawings, in which.

Figure 1:
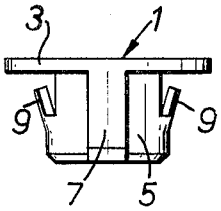
FIG. 1 is a side elevation of a bush forming part of the combination of the invention.
Figure 2:
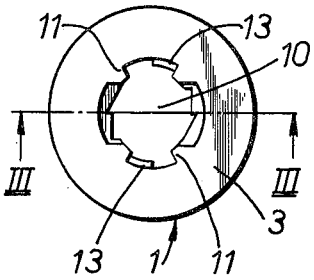
FIG. 2 is a plan view of the bush from above.
Figure 3:
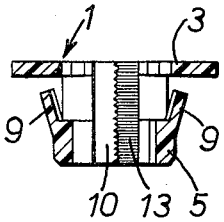
FIG. 3 is a section through the bush.

A device serving to help locate an electrical switch relative to a fixed position comprises a body in the form of a bush 1 of moulded plastics material and comprising a flat circular plate 3 having a boss 5 projecting from one face of the plate. The boss has a pair of projections 7 projecting from opposite sides of its periphery and which serve to allow the boss to be located in an opening in a metal plate and the projections prevent rotation of the boss relative to the plate. The boss also has a pair of resilient ears 9 which permit the boss to pass through an opening in the plate and then spring outwardly beneath the plate to lock the boss in position. An opening 10 extends through the plate 3 and the boss 5 and a pair of projections 11 extend into the opening from the side wall thereof. A plurality of members in the form of ribs 13 separated by grooves extend along part of the side wall of the opening and the members are arranged side-by-side in the direction parallel to the depth of the opening. In fact two sets of members are provided, each set extending the full depth of the opening. The sets are arranged on diagonally opposite parts of the wall of the opening.

Figure 4:
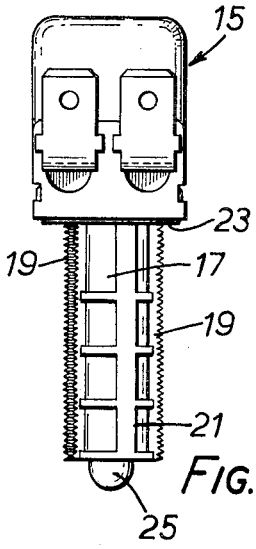
FIG. 4 is a side elevation of a switch having an elongate switch carrier.
Figure 5:
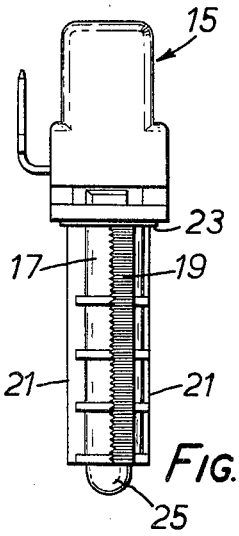
FIG. 5 is a side elevation of the switch and switch carrier shown in FIG. 4, taken at right angles to FIG. 4.
Figure 6:
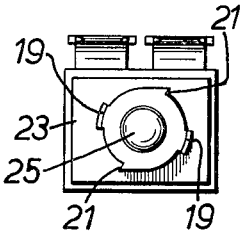
FIG. 6 is an end view of the switch and switch carrier shown in FIGS. 4 and 5.

Referring now to FIGS. 4, 5 and 6, an electric switch 15 is positioned at one end of a switch carrier which includes an elongate portion 17. The elongate portion carries two sets of members each in the form of ribs 19 separated by grooves. The ribs are spaced side-by-side in the direction parallel to the length of the elongate portion and the two sets are disposed on diametrically opposite sides of the elongate portion. Also on the elongate portion there are a pair of projections 21 extending the full length of the elongate portion. These two projections are disposed on diametrically opposite sides of the elongate portion and are located between the members 19.

In the arrangement shown in the figures the elongate portion is constituted by a neck tube having a flange 23 at right angles thereto and which forms part of the switch 15. It is possible however for the switch to be separate from the flange 23 and for the switch to be carried on the flange.

The dimensions of the ribs and grooves on the bush 1 and those on the elongate portion of the switch carrier are such that they can be brought into mating relation with each other to thereby prevent relative axial movement between the elongate portion 17 and the bush 1.

The switch 15 has an actuating member in the form of a plunger 25 which extends through the hollow elongate portion and which projects from the end thereof which is away from the body of the switch 15.

Figure 7:
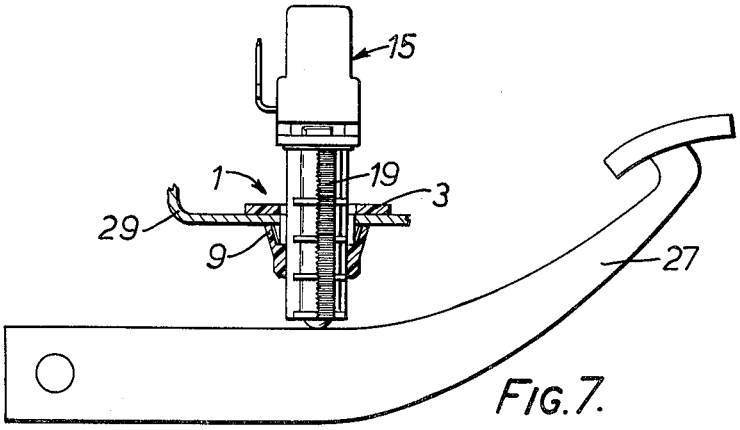
FIG. 7 is a sectional side elevation of the combination of the bush, switch carrier and switch mounted relative to the brake pedal of a motor vehicle.

FIG. 7 of the accompanying drawings shows the switch mounted in the bush in a position relative to the pivoted brake pedal 27 of a motor vehicle. A metal plate 29 is mounted in spaced relation from the pedal 27 and the plate has an opening therethrough. The bush 1 is introduced into the opening from the side away from the pedal 27 and the tongues 9 pass through the opening then spring out and engage the underside of the plate to lock the bush firmly in the plate. The elongate portion 17 of the carrier is then introduced into the opening in the bush 1 from the side which is away from the pedal 27. The carrier is passed through the bush until the plunger 25 engages with the pedal 27 thereby forcing the plunger into the elongate portion 17 and the end surface of the elongate portion abuts against the pedal. The carrier is then rotated relative to the bush through a limited angle to cause the ribs and grooves on the elongate portion of the carrier to mate with the corresponding ribs and grooves on the bush. This action locates the carrier axially with respect to the bush. The ribs and grooves on the bush and the carrier are inclined such that the limited rotation causes the carrier to move out of the bush to a limited extent sufficiently to allow the plunger to remain in engagement with the pedal 27 while the end face of the elongate portion 17 moves out of engagement with the pedal. The limited rotation causes the projections 21 on the carrier to move past the projections 11 on the bush to firmly locate the carrier in the bush. In normal operating conditions, any vibration which is present in the motor vehicle is insufficient to cause the projections 21 to move back relative to the projections 11. If, however, it is necessary to remove the carrier from the bush sufficient force can be applied to the carrier to rotate it in the opposite direction to cause the projections 11 and and possibly the projections 21 to deform and allow this angular rotation in the opposite direction to permit the ribs and grooves on the carrier to become disengaged from the ribs and grooves on the bush and the carrier can then be axially withdrawn from the bush. It is envisaged that, in use, it will only be necessary to remove the carrier from the bush on a very few occasions such as when the switch mechanism has to be removed for maintenance or replacement.

When the switch is assembled in the bush the plunger, which is in engagement with the brake pedal 27 actuates the contacts (not shown) in the switch to one operating condition but when the user of the motor vehicle depresses the brake pedal it pivots away from the plunger thereby allowing the plunger to move within the elongate portion of the carrier thereby actuating the contacts of the switch to their second operating condition.

We claim:

1. The combination of a body having an opening therein, a plurality of members extending around part of the side wall of the opening, said members being arranged side-by-side in the direction parallel to the depth of the opening, and a projection projecting from the side wall into the opening and a switch carrier having an elongate portion, a plurality of members extending around part of the side wall of the elongate portion, said members being arranged side-by-side in the direction parallel to the length of the elongate portion and a projection projecting outwardly from the side wall of the elongate portion, the opening in the body and the elongate portion of the switch carrier being such that the elongate portion is insertable in the direction of its length into the opening and by causing limited relative rotation between the elongate portion of the carrier and the body in a first direction members on the body and members on the carrier mate together to axially locate the carrier in the body and the projections being such that said relative rotation in the first direction cause them to take up relative positions which prevent relative rotation between the body and the elongate portion in the opposite direction unless the applied force to bring about relative rotation in said opposite direction is sufficient to deform one or both of the projections.

2. The combination as claimed in claim 1, wherein the members on the body and the switch carrier comprise ribs separated by grooves and said relative rotation in the first direction causes ribs on one of the body and switch carrier to mate with grooves on the other of the body and the switch carrier.

3. The combination as claimed in claim 2, wherein two sets of ribs separated by grooves are provided on the body and on the switch carrier.

4. The combination as claimed in claim 2 or 3, wherein the or each set of ribs and grooves on the body and the switch carrier are inclined to the depth of the opening in the body and to the length of the elongate portion respectively such that said relative rotation in the first direction causes the switch carrier to be displaced in the direction opposite to the direction of entry of the elongate portion into the opening.

5. The combination as claimed in claim 1, wherein the projection on the body comprises a detent extending for part of the depth of the opening and the projection on the elongate portion comprises a catch member extending for substantially the entire length of the elongate portion.

6. The combination claimed in claim 1, wherein the switch carrier has a part extending normal to the length of the elongate portion to permit an electric switch to be carried thereon.

7. The combination claimed in claim 1, in which the switch carrier forms part of an electric switch.

8. The combination claimed in claim 7, in which the elongate portion of the switch carrier is hollow and a plunger extends therethrough, said plunger serving as an actuating member for the switch.

9. The combination claimed in claim 8, wherein the body is in the form of a bush having said opening extending therethrough and adapted for mounting in an aperture in a metal plate.

10. The combination as claimed in claim 9, wherein the bush is mounted in a mounting bracket and the switch carrier is mounted in the bush with the plunger abutting against a pivoted brake pedal of a motor vehicle, the arrangement being such that, when the pedal is displaced to apply the brakes of the vehicle, it moves out of engagement with the plunger.

* * * * *